United States Patent [19]

Laidig

[11] Patent Number: 4,554,878

[45] Date of Patent: Nov. 26, 1985

[54] SEWING MACHINE PRESSER DEVICE WITH FEED DRIFT CONTROL

[75] Inventor: Manfred R. Laidig, Whippany, N.J.

[73] Assignee: The Singer Company, Stamford, Conn.

[21] Appl. No.: 680,209

[22] Filed: Dec. 10, 1984

[51] Int. Cl.[4] ..... D05B 29/06

[52] U.S. Cl. ..... 112/235; 112/323

[58] Field of Search ..... 112/235, 323, 320

[56] References Cited

U.S. PATENT DOCUMENTS

| | | | |
|---|---|---|---|
| 338,163 | 3/1886 | Gonpropst | 112/235 |
| 1,630,754 | 5/1927 | McNulty | 112/235 X |
| 2,207,977 | 7/1940 | Finn | 112/235 X |
| 3,094,089 | 6/1963 | Shuman | 112/235 |
| 3,146,743 | 9/1964 | Minehan | 112/235 X |
| 3,491,710 | 1/1970 | Bowin | 112/323 |

OTHER PUBLICATIONS

Superior Sewing Machine and Supply Corp., Master Catalog 69, N.Y., 1969.

Gutters Exchange, Catalog No. 4, Nashville, 1968.

*Primary Examiner*—Werner H. Schroeder

*Assistant Examiner*—Andrew M. Falik

*Attorney, Agent, or Firm*—Robert E. Smith; Edward L. Bell

[57] ABSTRACT

A presser foot and throat plate construction is disclosed for minimizing work feed drift in a sewing machine having a four-motion drop feed mechanism. By providing aligned and complemental ribs and recesses, one beneath the presser foot and the other in the throat plate, turning movement of the work fabric, which contributes to feed drift, is minimized and stitch forming characteristics of the sewing machine are enhanced.

8 Claims, 6 Drawing Figures

SEWING MACHINE PRESSER DEVICE WITH FEED DRIFT CONTROL

BACKGROUND OF THE INVENTION

1. Field of the Invention

This invention relates to the sewing machine art, and more particularly to a sewing machine of the type employing a four-motion drop feed mechanism working in opposition to a spring biased presser device. This invention is directed to a solution of the problem of minimizing undesirable lateral drift of work fabrics under the influence of a feed mechanism of the above character. This invention provides a novel presser foot construction which not only virtually eliminates one major cause of feed drift, but does so without sacrificing the versatility of the presser foot; and, in addition, significantly improves the stitch forming characteristics of the sewing machine.

2. Description of the Prior Art

It has long been recognized that the action of the work feed dog may contribute to feed drift and prior patents such as U.S. Pat. No. 3,527,183, Sep. 8, 1979, discuss this factor and teach means for constraining the feed dog to move in a path parallel to the intended line of feed to minimize feed drift from this cause. I am unaware of any prior teaching that the presser device might constitute a contributing factor to feed drift during the return stroke of the feed dog nor am I aware of any teaching of presser foot configurations which would alleviate this source of feed drift. Known presser foot sole plate configurations which include slots, ridges and the like as in U.S. Pat. No. 177,296, May 9, 1976, are provided in order to accommodate work piece protrusions such as stay strips, zipper fasteners, welts and the like, or as in U.S. Pat. No. 2,694,993, Nov. 23, 1954, are provided in order to lessen adhesion to certain types of work fabric. None of these known presser constructions exhibit the relationship to the throat plate as taught by this invention, and thus, none teaches the consequent advantageous beneficial effect minimizing feed drift as well as improving stitch forming characteristics of the sewing machine.

SUMMARY OF THE INVENTION

It is a primary object of this invention to minimize one major cause of work feed drift in a sewing machine having a four-motion drop feed mechanism which operates in opposition to a biased presser device. As is well known in the sewing machine art, a four-motion drop feed mechanism includes a feed dog and actuating mechanism for imparting to the feed dog work feed strokes while in a position extending through feed dog accommodating slots in a work supporting throat plate, and alternate return strokes while in a position retracted within the throat plate slots. The presser device includes a presser foot sole plate biased toward the throat plate to press work fabric in opposition to the throat plate during return strokes of the feed dog.

I have discovered that a major cause of work feed drift in this type of sewing machine is a slight turning increment imparted to the work fabric about the needle during the return stroke of the work feed dog. It is pointed out that the work fabric is not quiescent during the return stroke of the feed dog, but rather, forces are imparted to the work fabric during these periods, for instance, by the frictional drag of needle penetration, by tensions applied by the sewing threads, and possibly even by engagement by the presser device. Apparently, conventionally formed presser devices, being highly polished so as not to impede fabric flow, do not adequately resist such turning increments during work feed dog return strokes and undesirable work feed drift results. This invention provides for an arrangement of protruding ribs and aligned complemental recesses, one formed on the presser foot sole plate and the other on the throat plate, to enhance the work gripping effect when the presser device maintains the work fabric in opposition to the throat plate during return strokes of the feed dog.

It is preferable that the complemental ribs and receses be arranged substantially parallel to the direction of work feed stroke of the feed dog so as not to impede normal flow of the work fabric under influence of the work feed mechanism. It is also preferable for the ribs to protrude downwardly from the presser foot sole plate complemental to recesses formed in the throat plate in order to preserve the compatibility of the sewing machine with other fittings and accessories which might not obtain if the throat plate were to be ribbed.

Although a single rib and recess in accordance with this invention can be effective significantly to reduce work feed drift, a pair of cooperating ribs and recesses arranged one complemental set on each side of the needle aperture is preferable not only for attaining minimum work feed drift but also for holding the work fabric taut during needle penetration so as to minimize work flagging. As is known in the sewing machine art, work flagging can be detrimental to quality stitch formation in that it can contribute to skipping of stitches and it can adversely affect stitch setting. By reducing work flagging, this invention can thus improve the stitch forming characteristics of the sewing machine.

The most advantageous form of the present invention, however, is that which is illustrated in the accompanying drawings and described in detail hereafter in which the presser foot sole plate is formed with protruding ribs and the complemental recesses in the throat plate are provided by the feed dog slots. This arrangement is particularly cost effective since special recesses in the throat plate are not required and, moreover, this form of construction may be readily retrofit to existing sewing machines.

DESCRIPTION OF THE DRAWINGS

With the above and additional objects and advantages in view as will hereinafter appear, this invention is illustrated in the accompanying drawings in which.

DESCRIPTION OF THE INVENTION

Figure 1:
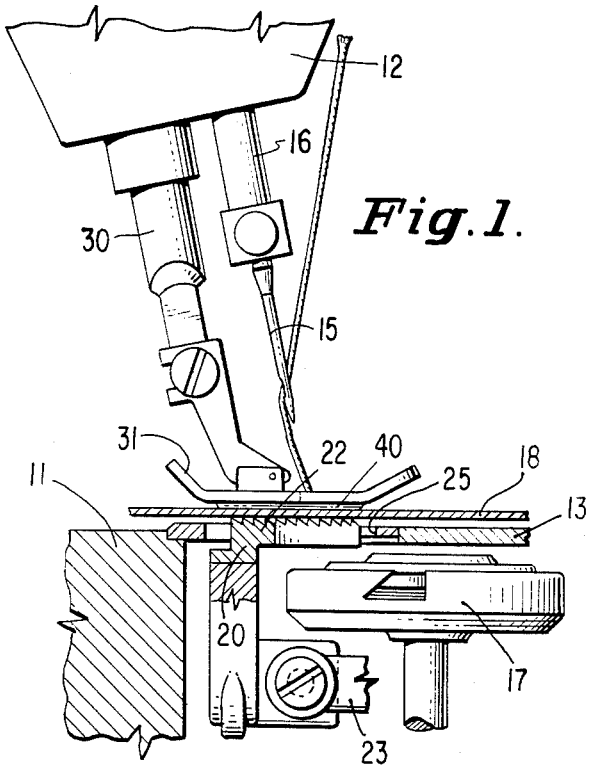
FIG. 1 is a cross sectional view of a portion of a sewing machine taken substantially through the stitching point and illustrating my invention applied thereto.

Referring to FIG. 1, portions of the frame of a typical sewing machine are illustrated including a bed 11 surmounted by a bracket arm 12. Carried on the bed 11 is a work supporting throat plate 13 formed with a needle aperture 14 through which a thread carrying needle 15 is endwise reciprocable. The needle is carried by a needle bar 16 supported in the bracket arm 12. Carried in the bed beneath the throat plate is a loop taker 17 which may be of any known form capable of concatenating thread carried by the needle with itself or with separate thread to form stitches in a work fabric 18 on the throat plate.

Also carried in the bed beneath the throat plate 13 is a work feed dog 20 of a four-motion drop feed mechanism. The feed dog preferably includes spaced limbs 21 and 22 arranged one on each side of the needle accommodating aperture 14 in the throat plate. Supporting and actuating mechanism 23 is provided for the work feed dog which mechanism may be of any conventional construction in the art and serves to impart a repeating series of four motions to the feed dog 20, to wit; a rising motion to extend the feed dog limbs 21 and 22 upwardly through slots 24, 25 in the throat plate into engagement with the work fabric 18; a work feed stroke in the direction of slots 24, 25 while extended above the throat plate, a descent to a position in which the feed dog limbs are retracted within the throat plate slots 24 and 25, and a return motion while retracted within the throat plate slots.

Figure 2:
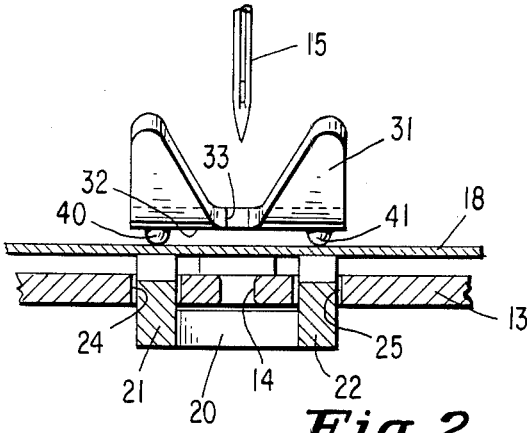
FIG. 2 is an enlarged cross sectional view of the machine of FIG. 1, but illustrating only the feed dog throat plate, work fabric and presser foot during the work feed stroke of the feed dog.
Figure 3:
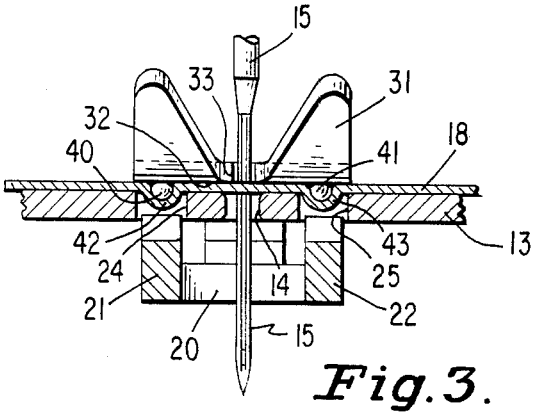
FIG. 3 is a cross sectional view similar to FIG. 2, but showing the parts including the needle during the return stroke of the feed dog.

Supported on a presser bar 30 in the bracket arm 12 is a presser foot 31 having a sole plate 32 which overlies portions of the throat plate 13 and the feed dog slots 24, 25 therein. The presser foot is biased downwardly by spring means (not shown) toward the throat plate as is conventional in the art so as to urge the work fabric 18 in opposition to the feed dog limbs 21 and 22 when the limbs are extended above the throat plate during work feed strokes of the feed dog as shown in FIG. 2. During the return strokes of the feed dog, the presser foot urges the work fabric in opposition to the throat plate 13 as shown in FIG. 3. During the return stroke of the feed dog, the needle 15 is also reciprocated through the work fabric 18 and through the needle aperture 14 in the throat plate. The presser foot 31 is also formed with a needle accommodating aperture 33 to accept needle reciprocation.

Figure 4:
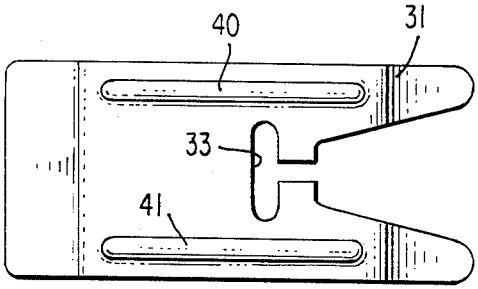
FIG. 4 is a bottom plan view of the presser foot of FIGS. 1, 2 and 3.
Figure 5:
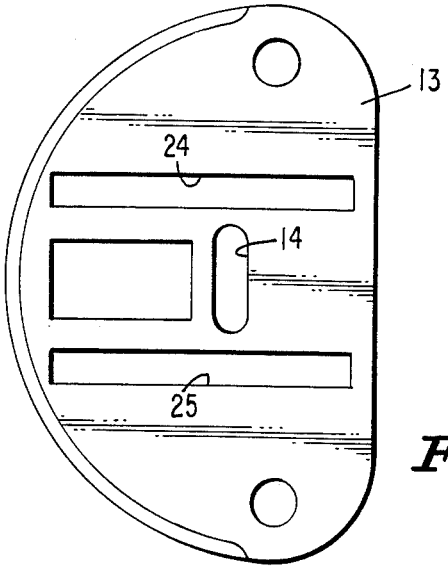
FIG. 5 is a top plan view of the throat plate of FIGS. 1, 2 and 3.

To augment the grip upon the work fabric 18 and to minimize any turning movement thereof about the needle 15 during return strokes of the feed dog, the presser foot sole plate is formed with depending ribs 40 and 41, one at each side of the needle aperture 33 therein. As shown in FIGS. 2 and 3, each of the ribs 40 and 41 is aligned centrally of one of the feed dog slots 24, 25 in the throat plate. As shown in FIGS. 2 and 3, the ribs are formed narrower than the slots 24 and 25 and, as shown in FIGS. 4 and 5, the ribs are shorter than the slots 24, 25 with the result that the ribs are complemental to and free to protrude into the slots during the feed dog return strokes and, in so doing, form slight wales 42, 43 in the work fabric, the wales extending into the feed dog slots 24, 25 as shown in FIG. 3. Two advantages accrue from this relationship of presser foot ribs with throat plate recesses; first, the grip of work fabric in opposition to any turning components of force exerted thereon is greatly enhanced so that feed drift of the work fabric is minimized, and second, the work fabrics are stretched taut across the needle aperture 14 in the throat plate thus minimizing flagging of the work in response to the friction of needle reciprocation and the thread tension during stitch formation, therefore improving stitch forming characteristics of the sewing machine.

Figure 6:
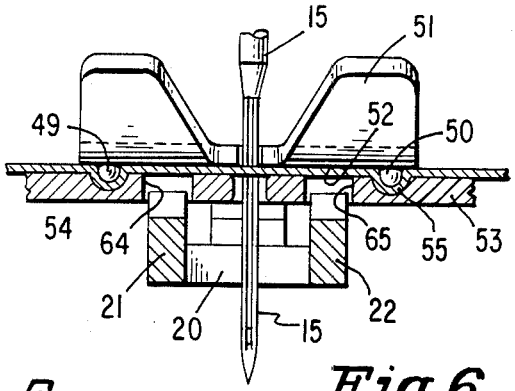
FIG. 6 is a cross sectional view similar to FIGS. 2 and 3, but illustrates a modified form of this invention.

FIG. 6 illustrates a modified form of the invention wherein the ribs 49, 50 protruding beneath the sole plate 52 of a presser foot 51 are aligned and complemental to recesses 54, 55 formed in the throat plate 53 adjacent and parallel to the feed dog slots 64, 65. In all other respects, the modified form of construction illustrated in FIG. 6 may be similar to that described with respect to that of FIGS. 1 to 5.

I claim:

1. In a sewing machine having stitch forming mechanism including an endwise reciprocatory thread carrying needle, a work fabric supporting throat plate formed with an aperture accommodating passage of said thread carrying needle, a four-motion drop feed mechanism including a feed dog, said throat plate being formed with at least one feed dog accommodating slot, means actuating said feed dog to partake of work feed strokes in an extended position through said throat plate feed dog accommodating slot and return strokes in a retracted position within said throat plate feed dog accommodating slot, and a presser foot including a sole plate biased toward said throat plate for engaging a work fabric in opposition to said feed dog during said work feed strokes and for engaging a work fabric in opposition to said throat plate during said return strokes, said presser foot sole plate and said throat plate being formed one with a protruding rib and the other with recess aligned with and complemental to said rib, said rib acting to press a wale of work fabric into said recess only during each return stroke of said work feed dog.

2. In a sewing machine as set forth in claim 1 in which said complemental protruding rib and aligned recess are arranged to extend substantially parallel to the direction of said feed dog work feed strokes.

3. In a sewing machine as set forth in claim 1 in which said presser foot sole plate is formed with said protruding rib and in which said throat plate is formed with said recess aligned with and complemental to said rib.

4. In a sewing machine as set forth in claim 1, said presser foot sole plate and said throat plate being formed one with a pair of protruding ribs and the other with a pair of recesses each aligned and complemental to one of said pair of ribs, said complemental ribs and recesses being arranged one at each side of said throat plate needle accommodating aperture, each rib acting to press a wale of work fabric into a complemental one of said recesses only during each return stroke of said work feed dog to lock the work fabric against movement during said feed dog return stroke and to minimize work flagging during needle passage through said throat plate aperture.

5. In a sewing machine as set forth in claim 4, in which said pair of complemental protruding ribs and aligned recesses are each arranged substantially parallel to the direction of said feed dog work feed strokes.

6. In a sewing machine as set forth in claim 4, in which each of said pair of ribs is formed protruding from said presser foot sole plate and in which each of said aligned and complemental recesses is formed in said throat plate.

7. In a sewing machine having a four-motion drop feed mechanism including a feed dog actuated alternately to partake of a work feed stroke and a return stroke, a work fabric supporting throat plate formed with at least one feed dog accommodating slot, said feed dog actuated to an extended position protruding through said throat plate slot during said work feed stroke and to a retracted position within said throat plate slot during said return stroke, and a presser foot including a sole plate biased toward said throat plate for engaging a work fabric in opposition to said feed dog during said work feed stroke and for engaging a work fabric in opposition to said throat plate during said return stroke, said presser foot sole plate being formed with a depending rib aligned longitudinally in the work feed direction and substantially centrally of said at least one throat plate feed dog accommodating slot, said presser foot sole plate rib being formed shorter and narrower than said aligned throat plate feed dog accommodating slot so as to depress a wale of a work fabric into said feed dog accommodating slot only during each return stroke of said work feed dog.

8. In a sewing machine having stitch forming mechanism including an endwise thread carying needle, a work fabric supporting throat plate formed with an aperture accommodating passage of said thread carrying needle, a four-motion drop feed mechanism including a feed dog having spaced work engaging limbs, said throat plate being formed with feed dog limb accommodating slots located one on each side of said needle accommodating aperture, means actuating said feed dog to partake of a work feed stroke and a return stroke, said actuating means shifting said feed dog limbs to an extended position through said throat plate slots during said work feed stroke and to a retracted position within said throat plate slots during said return stroke, and a presser foot including a sole plate biased toward said throat plate for engaging a work fabric in opposition to said feed dog limbs during said work feed stroke and for engaging a work fabric in opposition to said throat plate during said return stroke, said presser foot sole plate being formed with depending ribs each aligned substantially centrally of a different one of said feed dog limb accommodating throat plate slots, each of said presser foot sole plate ribs being formed shorter and narrower than the throat plate feed dog limb accommodating slot with which it is aligned enabling each rib to depress a wale of work fabric into one of said feed dog limb accommodating slots during each return stroke of said work feed dog.

* * * * *